US009823005B2

(12) United States Patent
Clanin et al.

(10) Patent No.: US 9,823,005 B2
(45) Date of Patent: Nov. 21, 2017

(54) METHODS AND SYSTEMS FOR DETECTING AND RECOVERING FROM CONTROL INSTABILITY CAUSED BY IMPELLER STALL

(71) Applicant: TRANE INTERNATIONAL INC., Piscataway, NJ (US)

(72) Inventors: Thomas J. Clanin, La Crescent, MN (US); Lee L. Sibik, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/763,436

(22) PCT Filed: Jan. 24, 2014

(86) PCT No.: PCT/US2014/013030
§ 371 (c)(1),
(2) Date: Jul. 24, 2015

(87) PCT Pub. No.: WO2014/117006
PCT Pub. Date: Jul. 31, 2014

(65) Prior Publication Data

US 2015/0362237 A1 Dec. 17, 2015

Related U.S. Application Data

(60) Provisional application No. 61/756,680, filed on Jan. 25, 2013.

(51) Int. Cl.
*F25B 1/00* (2006.01)
*F25B 49/00* (2006.01)
(Continued)

(52) U.S. Cl.
CPC ..... *F25B 49/02* (2013.01); *F04D 27/0292* (2013.01); *F25B 49/022* (2013.01);
(Continued)

(58) Field of Classification Search
CPC ..... F25B 49/02; F25B 49/022; F25B 2700/21161; F25B 2700/21172
See application file for complete search history.

(56) References Cited

U.S. PATENT DOCUMENTS 4,363,596 A 12/1982 Watson et al.
4,608,833 A * 9/1986 Kountz ..... F04D 27/0284 62/201

(Continued)

FOREIGN PATENT DOCUMENTS

KR 10-2006-0085628 7/2006
WO 2009-058975 5/2009

OTHER PUBLICATIONS

International Search Report and Written Opinion for International Application No. PCT/US2014/013030, dated May 20, 2014, 10 pgs.

*Primary Examiner* — Larry Furdge
(74) *Attorney, Agent, or Firm* — Hamre, Schumann, Mueller & Larson, P.C.

(57) ABSTRACT

Methods and systems for detecting and recovering from control instability caused by impeller stall in a chiller system are provided. In one embodiment, an impeller stall detection and recovery component of a chiller control unit calculates a control error signal frequency spectrum for an evaporator leaving water temperature, determines whether a high frequency signal content of the control error signal frequency spectrum exceeds acceptable limits, and adjusts a surge boundary control curve downward by a predetermined incremental value in order to resolve instability caused by impeller stall.

14 Claims, 4 Drawing Sheets

(51) Int. Cl.
*F25B 49/02* (2006.01)
*F04D 27/02* (2006.01)

(52) U.S. Cl.
CPC ..... *F25B 2500/19* (2013.01); *F25B 2600/023* (2013.01); *F25B 2700/195* (2013.01); *F25B 2700/197* (2013.01); *F25B 2700/21161* (2013.01); *F25B 2700/21172* (2013.01); *F25B 2700/21173* (2013.01)

(56) References Cited

U.S. PATENT DOCUMENTS

| | | | | |
|---|---|---|---|---|
| 5,146,764 | A * | 9/1992 | Bauman | F01D 17/143 415/119 |
| 5,553,997 | A * | 9/1996 | Goshaw | F04D 27/0261 415/17 |
| 5,913,248 | A | 6/1999 | Harada et al. | |
| 6,213,724 | B1 | 4/2001 | Haugen et al. | |
| 8,027,743 | B1 * | 9/2011 | Johnston | G10L 21/0208 700/94 |
| 2004/0037693 | A1 | 2/2004 | Stabley et al. | |
| 2005/0144965 | A1 * | 7/2005 | Ueda | F04D 27/0261 62/228.1 |
| 2008/0232950 | A1 * | 9/2008 | Stabley | F04D 27/001 415/1 |
| 2010/0269481 | A1 | 10/2010 | Snider et al. | |
| 2010/0296914 | A1 | 11/2010 | Staroselsky et al. | |

* cited by examiner

METHODS AND SYSTEMS FOR DETECTING AND RECOVERING FROM CONTROL INSTABILITY CAUSED BY IMPELLER STALL

FIELD OF TECHNOLOGY

The embodiments disclosed herein relate generally to a heating, ventilation, and air-conditioning ("HVAC") system, such as a chiller system, that has a centrifugal compressor. More particularly, the embodiments relate to methods and systems for detecting and recovering from control instability caused by impeller stall in a chiller system.

BACKGROUND

Chiller systems typically incorporate the standard components of a refrigeration loop to provide chilled water for cooling a designated building space. A typical refrigeration loop includes a compressor to compress refrigerant gas, a condenser to condense the compressed refrigerant to a liquid, and an evaporator that utilizes the liquid refrigerant to cool water. The chilled water can then be piped to the space to be cooled.

Chiller systems that utilize so called centrifugal compressors can typically range in size, for example, from ~100 to ~10,000 tons of refrigeration, and can provide certain advantages and efficiencies when used in large installations such as commercial buildings. The reliability of centrifugal chillers can be high, and the maintenance requirements can be low, as centrifugal compression typically involves the purely rotational motion of only a few mechanical parts.

A centrifugal compressor typically has an impeller that can be thought of as a fan with many fan blades. The impeller typically is surrounded by a duct. The refrigerant flow to the impeller can be controlled by variable inlet guide vanes ("IGV"s) located in the duct at the inlet to the impeller. The inlet guide vanes can operate at an angle to the direction of flow and cause the refrigerant flow to swirl just before entering the compressor impeller. The angle of the inlet guide vanes can be variable with respect to the direction of refrigerant flow. As the angle of the inlet guide vanes is varied and the inlet guide vanes open and close, the refrigerant flow to the compressor can be increased or decreased. In many applications, the inlet guide vanes can be variable ninety degrees between a fully closed position perpendicular to the direction of the refrigerant flow to a fully open inlet vane guide position in which the inlet guide vanes are aligned with the refrigerant flow. When the cooling load is high, the inlet guide vanes can be opened to increase the amount of refrigerant drawn through the evaporator, thereby increasing the operational cooling capacity of the chiller.

SUMMARY

Embodiments are provided for detecting and recovering from control instability caused by impeller stall in a chiller system.

In one embodiment, an impeller stall detection and recovery component of a chiller control unit calculates a control error signal frequency spectrum for an evaporator leaving water temperature, determines whether a high frequency signal content of the control error signal frequency spectrum exceeds acceptable limits, and adjusts a surge boundary control curve downward by a predetermined incremental value in order to resolve instability caused by impeller stall.

In one embodiment, an impeller stall detection and recovery component for detecting and restoring stable operation of a centrifugal compressor of a chiller system is provided. The impeller stall detection and recovery component includes a control error signal module, a control error signal frequency spectrum module, an impeller stall detection module and an impeller stall recovery module.

In another embodiment, a process for impeller stall detection and recovery of a centrifugal compressor in a chiller system is provided. The process includes calculating a chiller control error signal. The process also includes determining a frequency spectrum of the chiller control error signal. The process further includes whether impeller stall is detected. If impeller stall is detected, the process restores stable operation of the centrifugal compressor.

Other features and aspects of the methods and systems for detecting and recovering from instability caused by impeller stall will become apparent by consideration of the following detailed description and accompanying drawings.

BRIEF DESCRIPTION OF THE DRAWINGS

Referring now to the drawings in which like reference numbers represent corresponding parts throughout.

DETAILED DESCRIPTION

Figure 1:
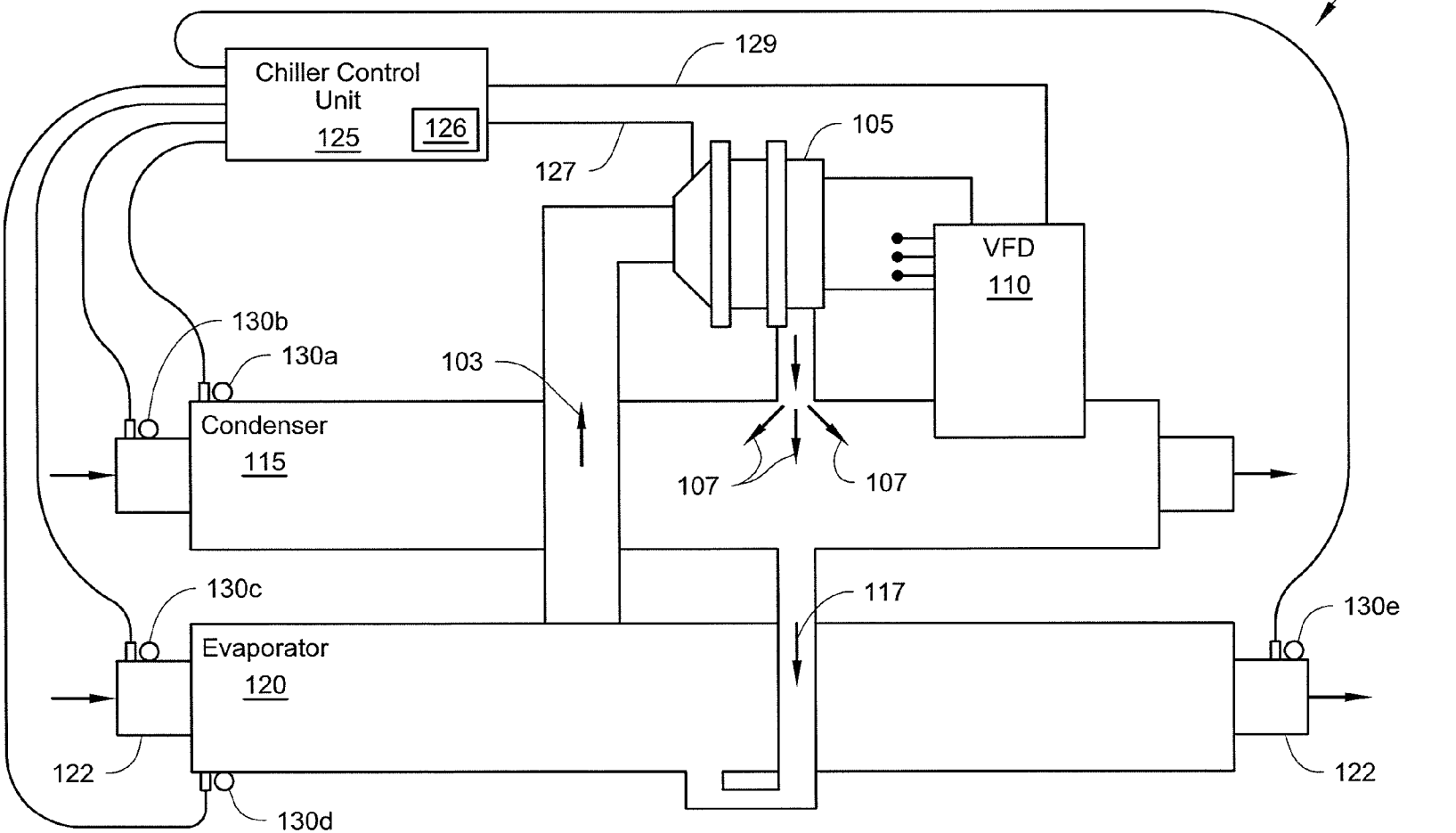
FIG. 1 illustrates a block diagram of a chiller system, according to one embodiment.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

Impeller stall is chiller system operation at high compressor coefficients near surge when one or more stages of the centrifugal compressor are unable to perform effective compression of a refrigerant. During surge, one or more of the impellers of the centrifugal compressor stall causing compressor gas flow reversal and large, rapid compressor motor current fluctuations.

The effect of impeller stall can be primarily indirect, resulting in a significant decrease in the pressure coefficient of the affected centrifugal compressor stage and a significant decrease in the overall chiller system capacity. This can result in a marked change in the gain and linearity characteristic of the chiller system and can cause chiller system control instability and unwanted limit-cycle oscillation. Also, during impeller stall, it has been found that unacceptable audible noise fluctuations can occur. Further, during impeller stall unacceptable oscillation in an evaporator leaving water temperature, an inlet guide vane position, and a centrifugal compressor speed command, via a variable speed drive, can occur. This can result in customer dissatisfaction due to reduced efficiency and reduced reliability.

In order to meet all conditions of demand in the air conditioned space, the chiller system can vary the output capacity. At times of high cooling demand, the centrifugal compressor can run at maximum load or full capacity. At other times the need for air conditioning is reduced and the centrifugal compressor can be run at a reduced capacity. The output of the chiller system then can be substantially less than the output at full capacity. It is also desired to operate the centrifugal compressor at the most efficient mode for the capacity that is required at any given time in order to reduce the electrical consumption of the chiller system to the lowest possible amount for the given load. The most efficient point of operation for a centrifugal compressor has been found to be near a condition known as surge. Operation in the surge condition, however, is undesirable as this can cause damage to the centrifugal compressor.

Conventional surge protection control strategies based on motor current fluctuations are ineffective for impeller stall detection. This is due to the fact that although the onset of impeller stall can be abrupt, motor current does not fluctuate during impeller stall.

Thus, the embodiments described herein are directed to improved detecting and recovering from instability caused by impeller stall in a chiller system.

The chiller system as described herein includes a centrifugal compressor that uses a variable speed drive (e.g., a variable frequency drive ("VFD")). While the embodiments described below use a variable frequency drive to control a centrifugal compressor speed of a centrifugal compressor, it will be appreciated that other types of variable speed drives may be used to control the centrifugal compressor speed of the centrifugal compressor.

FIG. 1 illustrates a block diagram of a chiller system 100 according to one embodiment. The chiller system includes a centrifugal compressor 105 having a VFD 110, a condenser 115, an evaporator 120 and a chiller control unit 125.

As generally shown in FIG. 1, the centrifugal compressor 105 is configured to compress refrigerant gas. The compressed refrigerant is then sent (shown by arrows 107) to the condenser 115. The condenser 115 condenses the compressed refrigerant into a liquid refrigerant. The liquid refrigerant is then sent (shown by arrow 117) to the evaporator 120. The evaporator 120 uses the liquid refrigerant to cool a fluid, e.g., water, flowing, via the piping 122, through the evaporator 120. The chilled water can then be piped into a space to be cooled. As the liquid refrigerant cools the water passing through the evaporator 120, the liquid refrigerant transforms into a gas, and the gas (shown by arrow 103) is then returned to the centrifugal compressor 105.

The chiller control unit 125 is configured to monitor operation of the chiller system 100 using measurement data obtained from a plurality of sensors 130*a-e* and control operation of the chiller system 100 based on, for example, changes in the load demanded by the air conditioning requirements of the space that is being cooled. The chiller control unit 125 can adjust for changes in the load demanded by the air conditioning requirements of the space that is being cooled by controlling the volume of refrigerant flow through the centrifugal compressor 105. This can be accomplished by varying the position of inlet guide vanes (not shown) of the centrifugal compressor 105 and a compressor speed of the centrifugal compressor 105, either separately or in a coordinated manner.

In particular, the chiller control unit 125 is configured to control operation of the centrifugal compressor 105 and the VFD 110 by sending an inlet guide vane command 127 to the centrifugal compressor 105 to control the position of the inlet guide vanes and by sending a compressor speed signal 129 to the VFD 110 to control the compressor speed of the centrifugal compressor 105.

Each of the plurality of sensors 130*a-e* is connected to the chiller control unit 125 and is configured to monitor a certain aspect of the chiller system 100 and send measurement data to the chiller control unit 125. The sensor 130*a* monitors a condenser refrigerant pressure. The sensor 130*b* monitors a condenser entering water temperature. The sensor 130*c* monitors an evaporator entering water temperature. The sensor 130*d* monitors an evaporator refrigerant temperature. The sensor 130*e* monitors an evaporator leaving water temperature.

The chiller control unit 125 also includes an impeller stall detection and recovery component 126 that is programmed to detect impeller stall and associated control instability and is programmed to restore stable operation of the chiller system 100. Specific details of the operation of the impeller stall detection and recovery component 126 are discussed below with respect to FIG. 2. The chiller control unit 125 generally can include a processor and a memory (not shown) to operate, for example, the impeller stall detection and recovery component 126.

Figure 2:
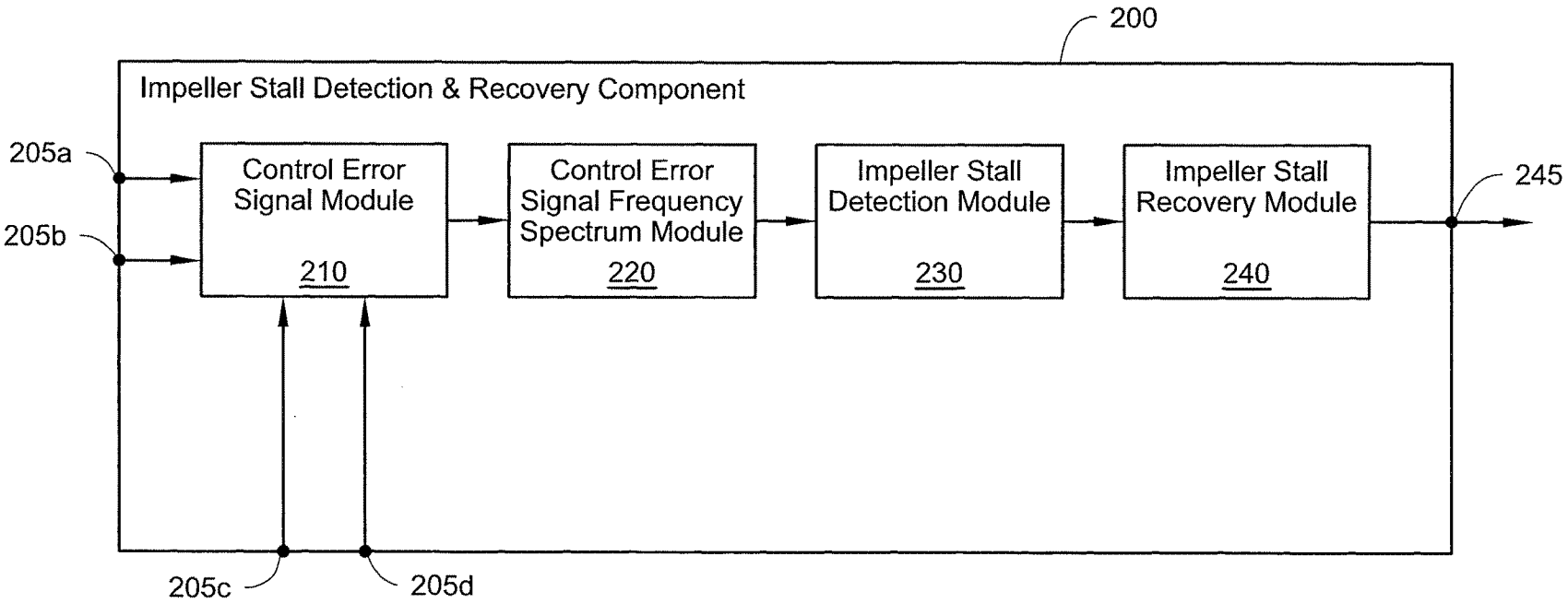
FIG. 2 illustrates a block diagram of an impeller stall detection and recovery component of the chiller control unit, according to one embodiment.

FIG. 2 illustrates one embodiment of a block diagram of an impeller stall detection and recovery component 200 for use in a chiller control unit of a chiller system, such as the chiller control unit 125 of the chiller system 100 shown in FIG. 1. The impeller stall detection and recovery component 200 is programmed to detect impeller stall and associated control instability and is programmed to restore stable operation of the chiller system 100.

The impeller stall detection and recovery component 200 includes a control error signal module 210, a control error signal frequency spectrum module 220, an impeller stall detection module 230 and an impeller stall recovery module 240. The impeller stall detection and recovery component 200 to receive also includes a plurality of inputs 205*a-c* and an output 245.

The plurality of inputs 205*a-e* is configured to receive information signals from different parts of the chiller system. For example, in one embodiment, the input 205*a* is configured to receive a filtered chilled water set point temperature signal from the chiller control unit. The input 205*b* is configured to receive an evaporator leaving water temperature signal from an evaporator leaving water temperature sensor (such as, for example, the sensor 130*d* in FIG. 1). The input 205*c* is configured to receive a design delta temperature signal that is indicative of the design delta temperature across the evaporator of the chiller system from the chiller control unit. In some embodiments, the design delta temperature across the evaporator can be ~10° F. The input 205*d* is configured to receive a lift compensation signal from the chiller control unit. The output 245 is configured to send a command signal to another component of the chiller control unit. For example, in one embodiment, the output 245 is configured to send a command signal to the chiller control unit that restores stable operation of the centrifugal compressor by translating an algorithm model for a surge boundary characteristic downward by a predetermined incremental value.

The control error signal module 210 is programmed to calculate a chiller control error signal and send the chiller control error signal to the control error signal frequency spectrum module 220. The control error signal frequency spectrum module 220 is programmed to determine a control error signal frequency spectrum signal based on the chiller control error signal and send the control error signal frequency spectrum signal to the impeller stall detection module 230. The impeller stall detection module 230 is programmed to determine whether impeller stall has occurred based on the controller error signal frequency spectrum signal and send an impeller stall detection signal to the impeller stall recovery module 240. The impeller stall recovery module 240 is programmed to restore stable operation of the centrifugal compressor of the chiller system upon receipt of an impeller stall detection signal from the impeller stall detection module 230 indicating that impeller stall has occurred.

Figure 3:
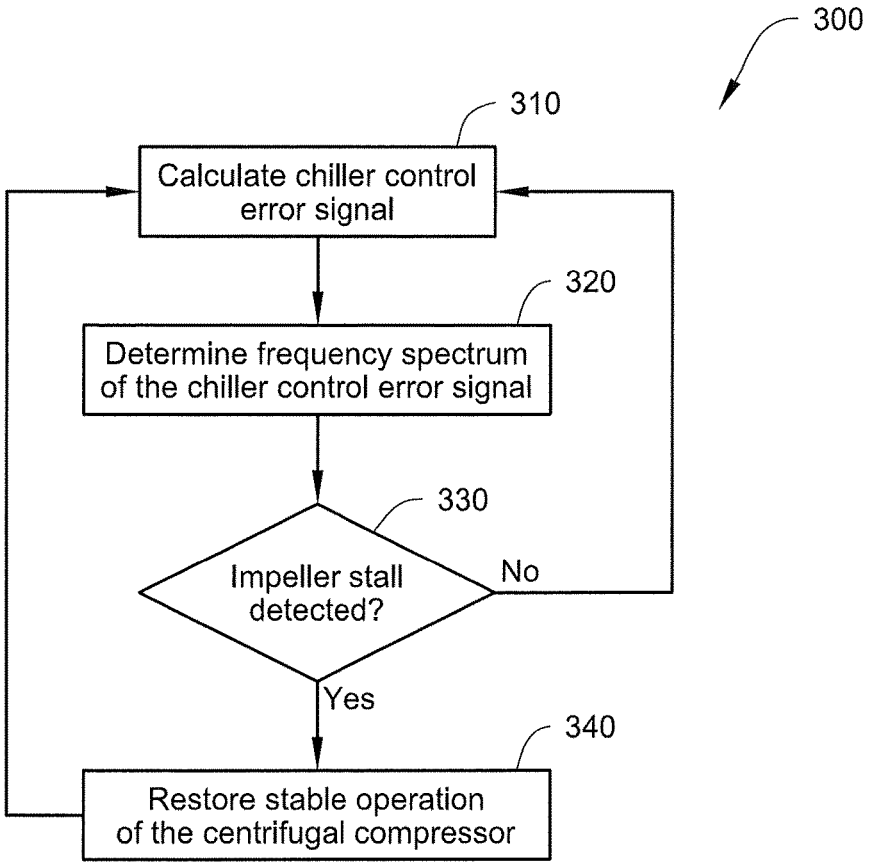
FIG. 3 illustrates a flowchart of a process for detecting and recovering from instability caused by impeller stall, according to one embodiment.

FIG. 3 illustrates a flowchart of a process 300 for detecting and recovering from instability caused by impeller stall using the impeller stall detection and recovery component 200. At 310, the control error signal module 210 calculates a chiller control error signal. In one embodiment, the control error signal module 210 can calculate the chiller control error signal based on a filtered chilled water set point temperature signal, an evaporator leaving water temperature signal, a design delta temperature signal, and a lift compensation signal using a leaving water temperature control algorithm. The chiller control error signal is then sent to the control error signal frequency spectrum module 220. The process 300 then proceeds to 320.

At 320, the control error signal frequency spectrum module 220 determines a frequency spectrum of the chiller control error signal. In one embodiment, the control error signal frequency spectrum module 220 is programmed to calculate control error signal frequency spectrum signal using a fast Fourier transform ("FFT") algorithm. The selection of FFT size and data sampling rate can determine the effective bandwidth and resolution of the control error signal frequency spectrum signal. In some embodiments, the control error signal frequency spectrum module 220 can use a 64 point FFT algorithm to allow the impeller stall detection module 230 the ability to distinguish normal control low frequency signal content from an unstable control high frequency signal content that is indicative of impeller stall. The control error signal frequency spectrum signal is then sent to the impeller stall detection module 230.

At 330, the impeller stall detection module 230 determines whether an impeller stall has occurred. In one embodiment, the impeller stall detection module 230 is programmed to determine whether impeller stall has occurred by evaluating the control error signal frequency spectrum signal.

It has been found that during stable operation of the centrifugal compressor of the chiller system, a frequency content of the control error signal frequency spectrum signal is particularly low. However, during impeller stall induced instability of the centrifugal compressor, the resulting limit cycle of the control error signal frequency spectrum signal has been found to have a relatively large magnitude, predominantly a single high frequency oscillation that can be distinguished from normal control operation.

For example, it has been found that an oscillation period of the control error signal during impeller stall induced instability to be about 45 to 80 seconds. During normal control operation, it has been found that the oscillation period of the control error signal frequency spectrum signals to be about 150 seconds or longer.

Thus, in one embodiment, the impeller stall detection module 230 can determine impeller stall by evaluating whether any predominantly high frequency signal content of the controller error signal frequency spectrum signal exceeds both low frequency signal content of the controller error signal frequency spectrum signal and a predetermined, adjustable set point threshold level.

If the impeller stall detection module 230 determines that the high frequency signal content of the controller error signal frequency spectrum signal exceeds both the low frequency signal content of the controller error signal frequency spectrum signal and the set point threshold level, the impeller stall detection module 230 determines that impeller stall in the chiller system has occurred. The impeller stall detection module 230 can then send an impeller stall detection signal to the impeller stall recovery module 240 that indicates that impeller stall has occurred and the process 300 proceeds to 340.

On the other hand, if the impeller stall detection module 230 determines that the high frequency signal content of the controller error signal frequency spectrum signal does not exceed either the low frequency signal content of the controller error signal frequency spectrum signal or the set point threshold level, the impeller stall detection module 230 determines that impeller stall in the chiller system has not occurred and the impeller stall detection module 230 sends an impeller stall detection signal to the impeller stall recovery module 240 that indicates that impeller stall has not occurred and the process 300 proceeds back to 310.

Figure 4:
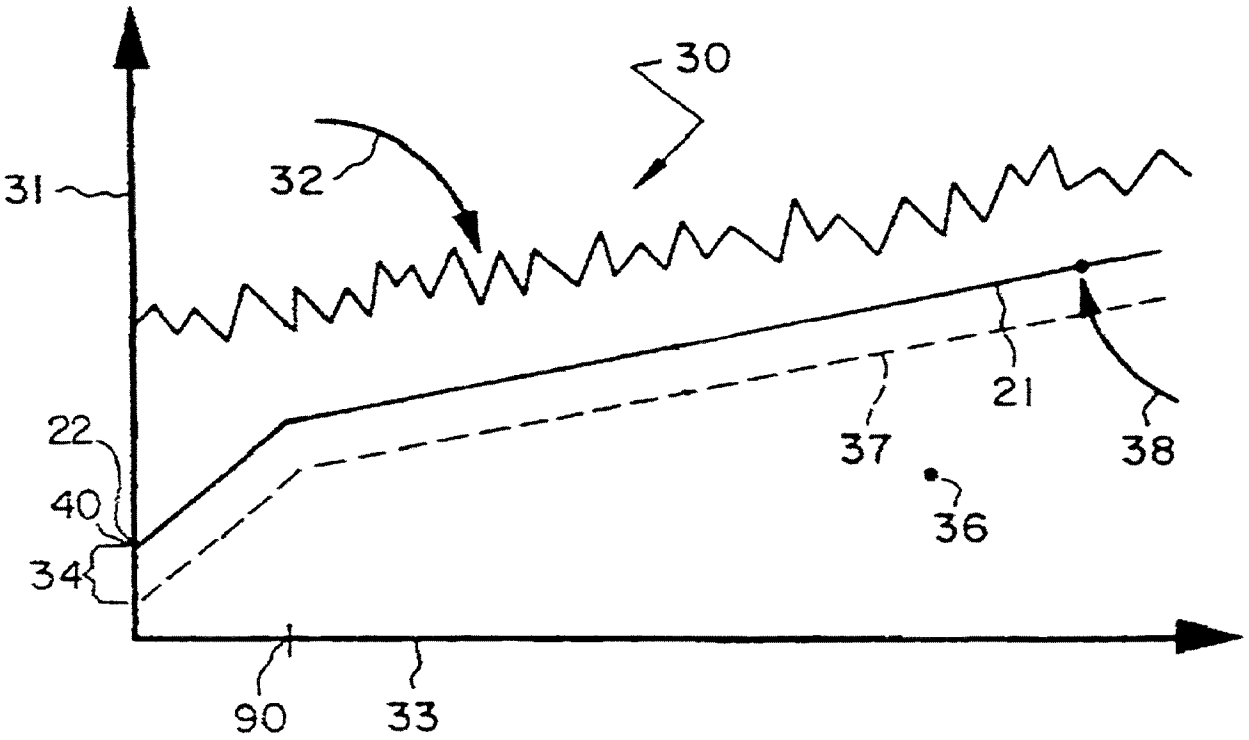
FIG. 4 illustrates a dimensionless plot of a chiller system operation as indicated by the relation of an inlet guide vane position to a pressure coefficient, according to one embodiment.

At 340, the impeller stall recovery module 240 restores stable operation of the centrifugal compressor. In some embodiments, the impeller stall recover module 240 restores stable operation of the centrifugal compressor by translating an algorithm model for a surge boundary characteristic downward by a predetermined incremental value. FIG. 4 illustrates one example of a surge boundary control curve 38 as a function of pressure coefficient versus an inlet guide vane position.

As shown in FIG. 4, a non-dimensional compressor map 30 is represented by a plot of a compressor pressure coefficient value 31 versus a compressor capacity value 33 calculated from sensor data during, for example, an evaporator leaving water temperature control sample period. Preferably, this sample period is as short as possible. Typically, a chiller system may operate, for example, with about a five second sample period. However, this can be modified as desired. The compressor capacity value 33 is a measurement of the cooling capacity of the chiller system that can be based upon a measured inlet guide vane position. The compressor pressure value 31 is a measurement of energy added to the refrigerant by the centrifugal compressor as the centrifugal compressor compresses the refrigerant gas.

These non-dimensional values take into account the relationship of impeller rotational speed on pressure rise and capacity as shown below. The compressor capacity can be considered the independent variable and can be determined based upon the measured inlet guide vane position. The chiller pressure coefficient (PC) can be determined in accordance with a relationship such as:

$$PC = \frac{(1.3159e9)(\text{Delta } H \text{ isentropic})}{(Numstages)\ (Dia^2)\,(N^2)}$$

Where:

N=Rotational speed of the impellers in RPM as calculated from a commanded inverter frequency neglecting motor slip. Neglecting motor slip can be a reasonable approximation for low slip motors.

Dia=Average Impeller Diameter.

Numstages=Number of compression stages in the chiller system.

Delta H isentropic=isentropic enthalpy rise, using the evaporator pressure and temperature and condenser pressure to calculate the enthalpy rise across the compressor.

In the non-dimensional compressor map 30, the compressor pressure coefficient is represented as the ordinate or Y-axis 31 and the compressor capacity is represented as the abscissa or X-axis 33.

A compressor operating point, shown for example at 36, can be calculated from sensor data every evaporator leaving water temperature control sample period. The compressor operating point 36 is a representation of the actual point of operation of the centrifugal compressor at the particular time that the sensor data is taken. The compressor operating point 36 is compared to the value of surge boundary control curve 38. The surge boundary control curve 38 is a calculated operating limit that is positioned proximate to a region 32 of actual surge as detected by intermittent surge events. The Y-intercept 22 of the surge boundary control curve 38 can be selected by the chiller control unit. Since the chiller control unit selects the Y-intercept 22 of the surge boundary control curve 38, the chiller control unit can define how aggressively to pursue energy efficiency. By making the Y-intercept 22 of the surge boundary control curve 38 close to the region 32 of actual surge, the most energy efficient operation can be achieved but at the risk of increased incidences of surge as the surge boundary control curve 38 approaches the region 32 of actual surge. The Y-intercept 22 can be set at considerable distance from the region 32 of actual surge to decrease the risk of surge by separating the surge boundary control curve 38 from the region 32 of actual surge. However, this is a trade off since the chiller system will expend more energy in its operation and thus not operate in the most optimal energy efficient operation.

Thus, in order to restore stable operation of the centrifugal compressor, the impeller stall recovery module 240 can translate the algorithm model for the surge boundary control curve 38 downward by a predetermined incremental value 34 to obtain a new surge boundary control curve 37 and thereby decreasing a target pressure coefficient. By reducing the target pressure coefficient, a compressor speed of the centrifugal compressor can be increased, an opening position of the inlet guide vanes can be decreased and the impeller stall condition can be reduced and eventually eliminated.

Returning to FIG. 3, once the impeller stall recovery module 240 restores stable operation of the centrifugal compressor, the process 300 returns to 310.

Aspects:

It is noted that any of aspects 1-9 can be combined with any of aspects 10-18.

1. A method for detecting and recovering from control instability caused by impeller stall in a chiller system that includes a centrifugal compressor, a chiller control unit and one or more inlet guide vanes, the method comprising:
   calculating a chiller control error signal;
   determining a frequency spectrum of the chiller control error signal to obtain a controller error signal frequency spectrum signal;
   detecting, via the chiller control unit, whether an impeller stall event has occurred based on the controller error signal frequency spectrum signal;
   restoring stable operation of the centrifugal compressor when an impeller stall event is detected.
2. The method of aspect 1, wherein calculating the chiller control error signal includes using a leaving water temperature control algorithm.
3. The method of either of aspects 1 and 2, wherein the chiller control error signal is calculated based on at least one of a chilled water set point temperature signal, an evaporator leaving water temperature signal, a design delta temperature signal and a lift compensation signal.
4. The method of any of aspects 1-3, wherein the frequency spectrum of the chiller control error signal is determined using a fast Fourier transform algorithm.
5. The method of aspect 4, wherein the fast Fourier transform algorithm is a 64 point fast Fourier transform algorithm.
6. The method of any of aspects 1-5, wherein detecting whether the impeller stall event has occurred based on the controller error signal frequency spectrum signal includes at least one of:
   a high frequency signal content of the controller error signal frequency spectrum signal exceeding a low frequency signal content of the controller error signal frequency spectrum signal; and
   the high frequency signal content of the controller error signal frequency spectrum signal exceeding a set point threshold level.
7. The method of any of aspects 1-5, wherein detecting whether the impeller stall event has occurred based on the controller error signal frequency spectrum signal includes both of:
   a high frequency signal content of the controller error signal frequency spectrum signal exceeding a low frequency signal content of the controller error signal frequency spectrum signal; and
   the high frequency signal content of the controller error signal frequency spectrum signal exceeding a set point threshold level.
8. The method of any of aspects 1-7, wherein restoring stable operation of the centrifugal compressor includes:
   operating the chiller system under a surge boundary characteristic this is incrementally smaller than a previously operated at surge boundary characteristic.
9. The method of any of aspects 1-7, wherein restoring stable operation of the centrifugal compressor includes at least one of increasing a compressor speed of the centrifugal compressor and decreasing an opening position of the one or more inlet guide vanes.
10. A chiller system comprising:
    a centrifugal compressor;
    one or more inlet guide vanes; and
    a chiller control unit that includes an impeller stall detection and recovery component, the impeller stall detection and recovery component includes:
    a control error signal module configured to calculate a chiller control error signal,
    a control error signal frequency spectrum module configured to determine a frequency spectrum of the chiller control error signal to obtain a controller error signal frequency spectrum signal,
    an impeller stall detection module configured to detect whether an impeller stall event has occurred based on the controller error signal frequency spectrum signal, and
    an impeller stall recovery module configured to restore stable operation of the centrifugal compressor when an impeller stall event is detected.

11. The chiller system of aspect 10, wherein the control error signal module is configured to calculate the chiller control error signal using a leaving water temperature control algorithm.

12. The chiller system of either of aspects 10 and 11, wherein the control error signal module is configured to calculate the chiller control error signal based on at least one of a chilled water set point temperature signal, an evaporator leaving water temperature signal, a design delta temperature signal and a lift compensation signal.

13. The chiller system of any of aspects 10-12, wherein the control error signal frequency spectrum module is configured to determine the frequency spectrum of the chiller control error signal using a fast Fourier transform algorithm.

14. The chiller system of aspect 13, wherein the fast Fourier transform algorithm is a 64 point fast Fourier transform algorithm.

15. The chiller system of any of aspects 10-14, wherein the impeller stall detection module is configured to detect whether the impeller stall event has occurred when at least one of:

a high frequency signal content of the controller error signal frequency spectrum signal exceeds a low frequency signal content of the controller error signal frequency spectrum signal, and the high frequency signal content of the controller error signal frequency spectrum signal exceeds a set point threshold level.

16. The chiller system of any of aspects 10-14, wherein the impeller stall detection module is configured to detect whether the impeller stall event has occurred when both of:

a high frequency signal content of the controller error signal frequency spectrum signal exceeds a low frequency signal content of the controller error signal frequency spectrum signal, and the high frequency signal content of the controller error signal frequency spectrum signal exceeds a set point threshold level.

17. The chiller system of any of aspects 10-16, wherein the impeller stall recover module is configured to restore stable operation of the centrifugal compressor by operating the chiller system under a surge boundary characteristic this is incrementally smaller than a previously operated at surge boundary characteristic.

18. The chiller system of any of aspects 10-17, the impeller stall recover module is configured to restore stable operation of the centrifugal compressor by at least one of:

increasing a compressor speed of the centrifugal compressor, and decreasing an opening position of the one or more inlet guide vanes.

While only certain features of the embodiments have been illustrated and described herein, many modifications and changes will occur to those skilled in the art. It is, therefore, to be understood that the appended claims are intended to cover all such modifications and changes as fall within the true spirit of the embodiments described herein.

The invention claimed is:

1. A method for detecting and recovering from control instability caused by impeller stall in a chiller system that includes a centrifugal compressor, a chiller control unit and one or more inlet guide vanes, the method comprising:

calculating a chiller control error signal based on a chilled water set point temperature signal, an evaporator leaving water temperature signal, a design delta temperature signal that is indicative of a design delta temperature across an evaporator of the chiller system and a lift compensation signal, wherein calculating the chiller control error signal includes using a leaving water temperature control algorithm;

determining a frequency spectrum of the chiller control error signal to obtain a controller error signal frequency spectrum signal, wherein the frequency spectrum of the chiller control error signal is determined using a fast Fourier transform algorithm;

detecting, via the chiller control unit, whether an impeller stall event has occurred based on the controller error signal frequency spectrum signal;

restoring stable operation of the centrifugal compressor when an impeller stall event is detected.

2. The method of claim 1, wherein the fast Fourier transform algorithm is a 64 point fast Fourier transform algorithm.

3. The method of claim 1, wherein detecting whether the impeller stall event has occurred based on the controller error signal frequency spectrum signal includes at least one of:

a high frequency signal content of the controller error signal frequency spectrum signal exceeding a low frequency signal content of the controller error signal frequency spectrum signal; or the high frequency signal content of the controller error signal frequency spectrum signal exceeding a set point threshold level.

4. The method of claim 1, wherein detecting whether the impeller stall event has occurred based on the controller error signal frequency spectrum signal includes both of:

a high frequency signal content of the controller error signal frequency spectrum signal exceeding a low frequency signal content of the controller error signal frequency spectrum signal; and the high frequency signal content of the controller error signal frequency spectrum signal exceeding a set point threshold level.

5. The method of claim 1, wherein restoring stable operation of the centrifugal compressor includes:

operating the chiller system under a surge boundary characteristic that is incrementally smaller than a previously operated at surge boundary characteristic.

6. The method of claim 1, wherein restoring stable operation of the centrifugal compressor includes at least one of increasing a compressor speed of the centrifugal compressor or decreasing an opening position of the one or more inlet guide vanes.

7. A chiller system comprising:

a centrifugal compressor;

one or more inlet guide vanes; and a chiller control unit that includes an impeller stall detection and recovery component, the impeller stall detection and recovery component includes:

a control error signal module configured to calculate a chiller control error signal based on a chilled water set point temperature signal, an evaporator leaving water temperature signal, a design delta temperature signal and a lift compensation signal, a control error signal frequency spectrum module configured to determine a frequency spectrum of the chiller control error signal to obtain a controller error signal frequency spectrum signal, wherein the control error signal frequency spectrum module is configured to determine the frequency spectrum of the chiller control error signal using a fast Fourier transform algorithm, an impeller stall detection module configured to detect whether an impeller stall event has occurred based on the controller error signal frequency spectrum signal, and an impeller stall recovery module configured to restore stable operation of the centrifugal compressor when an impeller stall event is detected.

8. The chiller system of claim 7, wherein the control error signal module is configured to calculate the chiller control error signal using a leaving water temperature control algorithm.

9. The chiller system of claim 7, wherein the fast Fourier transform algorithm is a 64 point fast Fourier transform algorithm.

10. The chiller system of claim 7, wherein the impeller stall detection module is configured to detect whether the impeller stall event has occurred when at least one of:

a high frequency signal content of the controller error signal frequency spectrum signal exceeds a low frequency signal content of the controller error signal frequency spectrum signal, or the high frequency signal content of the controller error signal frequency spectrum signal exceeds a set point threshold level.

11. The chiller system of any of claim 7, wherein the impeller stall detection module is configured to detect whether the impeller stall event has occurred when both of:

a high frequency signal content of the controller error signal frequency spectrum signal exceeds a low frequency signal content of the controller error signal frequency spectrum signal, and the high frequency signal content of the controller error signal frequency spectrum signal exceeds a set point threshold level.

12. The chiller system of claim 7, wherein the impeller stall recover module is configured to restore stable operation of the centrifugal compressor by operating the chiller system under a surge boundary characteristic this is incrementally smaller than a previously operated at surge boundary characteristic.

13. The chiller system of claim 7, the impeller stall recover module is configured to restore stable operation of the centrifugal compressor by at least one of:

increasing a compressor speed of the centrifugal compressor, or decreasing an opening position of the one or more inlet guide vanes.

14. The chiller system of claim 7, wherein the design delta temperature signal is indicative of a design delta temperature across an evaporator of the chiller system.

* * * * *